United States Patent [19]

Dailey et al.

[11] 4,367,869

[45] Jan. 11, 1983

[54] STIRRUP ATTACHMENT FOR SURGICAL TABLE

[76] Inventors: Thomas H. Dailey, 347 E. 84 St., New York, N.Y. 10028; Gregory W. Brabbee, 74 Brayton St., Englewood, N.J. 07631

[21] Appl. No.: 300,925

[22] Filed: Sep. 10, 1981

[51] Int. Cl.[3] ..... A61G 13/00

[52] U.S. Cl. ..... 269/324; 269/328; 269/67; 269/79

[58] Field of Search ..... 269/322–328, 269/79, 67–68; 297/439; 5/443, 444, 446; 128/80 R, 134

[56] References Cited

U.S. PATENT DOCUMENTS

| | | | |
|---|---|---|---|
| 2,057,992 | 10/1936 | Wiruth | 269/328 |
| 2,459,033 | 1/1949 | Kraus | 269/328 |
| 2,581,110 | 1/1952 | Kenworthy | 5/444 |
| 2,732,269 | 1/1956 | Astroff | 269/328 |
| 3,817,512 | 6/1974 | Torrey | 269/328 |

FOREIGN PATENT DOCUMENTS

| | | | |
|---|---|---|---|
| 1262696 | 4/1961 | France | 269/328 |
| 1291572 | 6/1962 | France | 269/328 |

OTHER PUBLICATIONS

The Hospital Supply Company, Catalogue, p. 26, 1956.

*Primary Examiner*—Robert C. Watson

*Attorney, Agent, or Firm*—Cooper, Dunham, Clark, Griffin & Moran

[57] ABSTRACT

A stirrup attachment for a surgical table includes an extendable support shaft provided at one end with an attachment means rotatable about the shaft for attaching the stirrup attachment to a surgical table and at the other end with a hinging means. Adjustable calf and thigh support members are hingedly attached to the shaft and include calf and thigh support portions and rods provided with slots. A slideable adjustable sleeve member on the shaft includes engagement members for the slots so as to permit independent movement of the calf and thigh support members relative to the shaft and to one another. Locking means are provided for fixing the shaft, attachment members are sleeve in desired positions.

9 Claims, 4 Drawing Figures

Fig. 1.
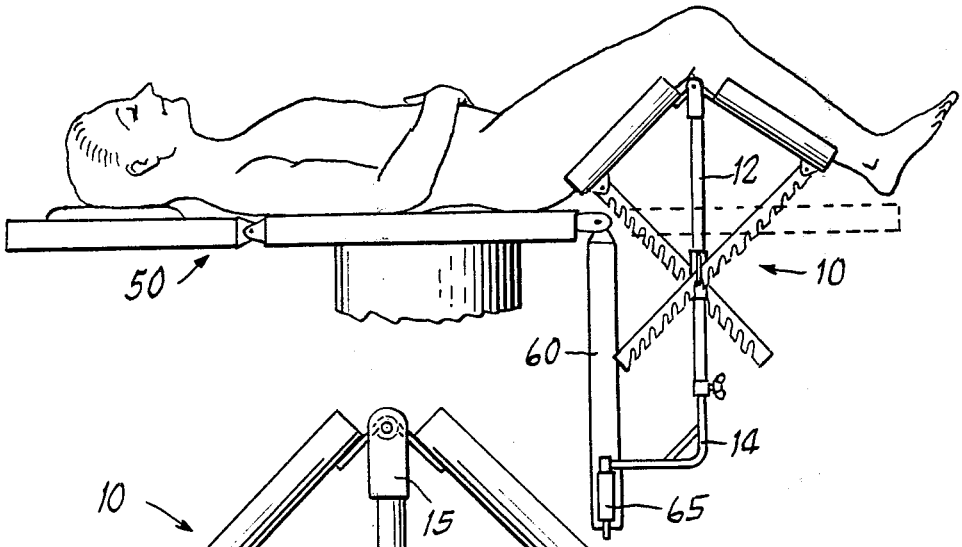
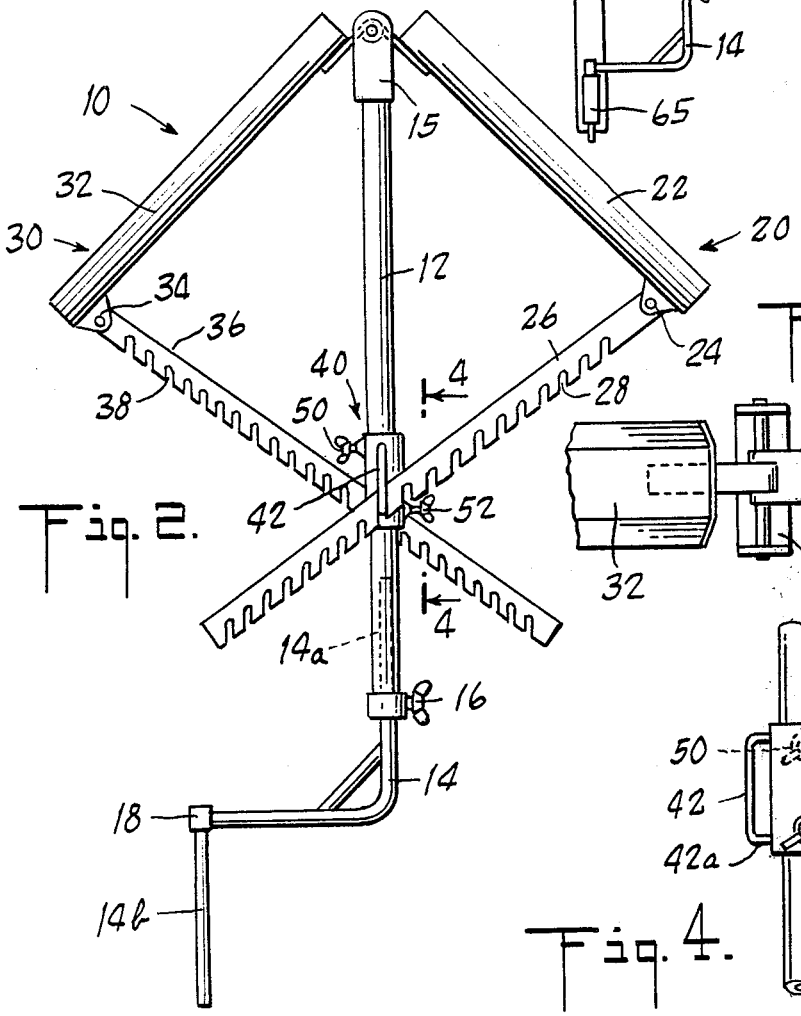
Fig. 2.
Fig. 3.
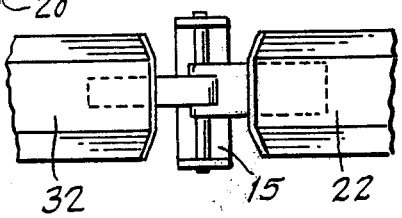
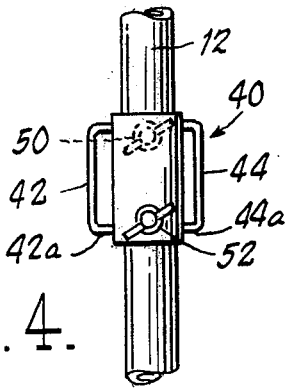
Fig. 4.

STIRRUP ATTACHMENT FOR SURGICAL TABLE

Stirrup attachments for tables employed in the practice of medicine are well known. Particularly common are stirrup attachments for obstetric tables such as those disclosed in U.S. Pat. No. 1,607,168 (1924); U.S. Pat. No. 2,682,437 (1954); U.S. Pat. No. 2,832,655 (1958); and U.S. Pat. No. 4,247,091 (1981). In addition, stirrup attachments are known for examining tables, U.S. Pat. No. 1,749,867 (1930); urological tables, U.S. Pat. No. 1,919,908 (1929); and operating tables, U.S. Pat. No. 2,647,026 (1953).

However, the stirrup attachments previously employed are not completely satisfactory for some types of surgical procedures. For example, such stirrup attachments are not ideally suited for simultaneous abdominal and rectal surgery which typically involves more than one surgeon working on a patient at the same time. To overcome the shortcomings of known stirrup mechanisms, this invention provides a new stirrup attachment suitable for use with a wide variety of surgical tables.

The stirrup attachment of this invention includes an extendable support shaft which is provided at its lower end with an attachment member for affixing the shaft to a surgical table. The shaft and attachment member are constructed so that the shaft is capable of rotation about the attachment member. At the upper end, the shaft is provided with a hinging means. A locking means is located on either the shaft or the attachment member so that the shaft can be fixed in a desired position relative to the attachment member. An adjustable calf support member is attached to the shaft by the hinging means. It includes a portion, adapted to receive and support a human calf, attached directly to the hinging means and a rod provided with a series of slots pivotally attached to the calf support portion. An adjustable thigh support member is also attached to the shaft by the hinging means. It includes a portion adapted to receive and support a human thigh attached directly to the hinging means, opposite the calf support portion, and a rod provided with a series of slots pivotally attached to the thigh support portion. The stirrup attachment also includes a slideably adjustable sleeve member on the shaft. This sleeve is provided with two engagement members, each adapted to receive and hold one of the rods by engaging one of the slots disposed along the rods. By means of the rods, the calf and thigh support members can be separately adjusted, and by means of the slots and engagement members, they can be independently held in desired positions. The sleeve also includes a locking means for fixing the sleeve in a desired position relative to the shaft.

BRIEF DESCRIPTION OF THE DRAWINGS

FIG. 1 is a side view of one embodiment of the stirrup attachment of the invention shown mounted on a surgical table.

FIG. 2 is an enlarged side view of the stirrup attachment.

FIG. 3 is a partial top view looking down on the stirrup attachment of FIG. 2.

FIG. 4 is a sectional view of the shaft of the stirrup attachment taken along line 4—4 of FIG. 2.

DETAILED DESCRIPTION OF THE INVENTION

The stirrup attachment of the present invention is shown in FIGS. 1 through 4, and is described hereinafter by reference to these drawings.

FIG. 1 shows stirrup attachment 10 mounted by means of a receptacle member 65 to the fall-away portion 60 of surgical table 50. FIG. 1 further illustrates the use of the stirrup attachment to support the right leg of a patient lying prostrate on a surgical table. Of course, it will be readily understood that in practice the surgical table will generally be provided with two stirrup attachments mounted on both ends of the fall-away portion of the surgical table so as to support both the right and the left legs of a patient.

Referring now to FIG. 2, the presently preferred embodiment of the stirrup attachment of this invention is shown. Stirrup attachment 10 includes support shaft 12, which may be constructed of any of a wide range of materials, including metals and plastics, the only limitation being that the material have sufficient strength to support the weight of a person's leg placed on the stirrup attachment. In addition, shaft 12 may be solid or hollow and may be constructed in a number of different shapes, including tubular and cylindrical shapes. In order to permit movement upwardly and downwardly of a patient's leg which is held on the stirrup attachment, shaft 12 should be extendable.

Stirrup attachment 10 also includes at its lower end an attachment member 14 for affixing support shaft 12 to a surgical table. Attachment member 14 may similarly be constructed in various shapes, sizes and materials. The attachment member 14 and shaft 12 are so constructed as to permit the shaft and the attachment member to rotate relative to one another. In this way, the legs of a patient on a surgical table may be spread to the extent desired. In the embodiment shown in FIG. 2, shaft 12 is hollow and attachment member 14 includes a pin portion 14*a* inserted into the hollow shaft. Shaft 12 then may be lengthened or shortened by moving shaft 12 upwardly and downwardly, respectively, along pin portion 14*a*. Attachment member 14 also includes a second pin portion 14*b* which may be inserted in a suitable receiving member on a surgical table such as receptacle 65 shown in FIG. 1. Stirrup attachment 10 also includes a locking means 16 for securely holding support shaft 12 in a desired position relative to attachment number 14. Locking means 16 may be located at other positions than that shown in FIG. 2. However, the embodiment shown permits a single locking means to be employed for holding the shaft in desired, rotated and extended positions. Various types of locking means may be employed such as various frictionally engageable locking means, including wing-nut and bolt combinations. Attachment member 14 also may include a joint member 18 which permits rotational movement of the stirrup attachment and shaft relative to pin 14*b*.

At the top end of shaft 12 there is located a hinging means 15, which may be seen more clearly in the view looking down on the hinging means shown in FIG. 3. An adjustable calf support member 20 is hingedly attached to hinging means 15. The calf support member 20 includes a portion 22 adapted to receive and support the calf of a patient lying prostrate on a surgical table. For this purpose, various semi-cylindrical or semi-tubular members having sloping side walls may be employed. At the other end of the calf receiving portion 22, a rod 26 is pivotally attached by a suitable means 24. Rod 26 includes a series of slots 28 downwardly projecting. By movement of rod 26, it is possible to adjust the angle at which a calf is held in the calf receiving portion 22.

Stirrup attachment 10 also includes an adjustable thigh support member 30 which comprises a portion 32 adapted to receive and support a human thigh. Portion 32 is hingedly attached at one end to hinging means 15. At the other end, a second rod 36 is pivotally attached by a suitable means 34. Rod 36 is also provided with a series of downwardly directed slots 38. The calf and thigh support portions are so attached to the hinging means 15 as to permit a leg placed on stirrup attachment 10 to be aligned with the bottom of the knee positioned on top of hinging means 15. Independent adjustment of the angle of thigh support member 30 relative to shaft 12 is possible by moving rod 36.

A slideably adjustable sleeve member 40 is placed around the shaft. This sleeve member is provided with two engagement members such as the two U-shaped members 42 and 44 shown in FIG. 4. U-shaped members 42 and 44 are located along opposite sides of sleeve 40 and extend parallel to one another and to the length of shaft 12. The lower portions of the U-shaped members are adapted to engage the slots provided in the rods. Thus, lower portions 42*a* of U-shaped member 42 is adapted to receive one of the slots 38 of rod 36, and lower portion 44*a* of U-shaped member 44 is adapted to receive one of slots 28 of rod 26. When the slots are engaged by the lower portions of the U-shaped members, the thigh and calf supports are firmly and securely held in place.

Sleeve 40 is also provided with a locking means for fixing the sleeve in a desired position along the shaft, such as frictionally engageable wing-nut and bolt combinations 50 and 52.

In operation, the stirrup attachment of this invention permits a leg which is placed on the stirrup attachment to the readily and efficiently moved during a surgical procedure. The stirrup attachment permits movement of the leg in various desirable manners including spreading of the legs, lowering and raising of the entire leg, and independent lowering and raising of the calf and thigh portions of the leg.

It will be readily understood that numerous modifications and variations may be made in the stirrup attachment without departing from the spirit and scope of the invention as set forth in the claims which follow hereinafter.

What is claimed is:

1. A stirrup attachment for a surgical table which comprises:

an extendable support shaft provided at one end with an attachment member for attaching the support shaft to a surgical table and hinging means at its other end, the shaft being rotatable about the attachment member;

a first locking means for fixing the support shaft in a desired position relative to the attachment member;

an adjustable calf support member, comprising a portion adapted to receive and support a human calf hingedly attached at one end to said hinging means and a first rod provided with a series of slots pivotally attached to the other end of said calf support portion;

an adjustable thigh support member, comprising a portion adapted to receive and support a human thigh, hingedly attached at one end to said hinging means opposite said calf support portion and a second rod provided with a series of slots pivotally attached to the other end of said thigh support portion;

a slideably adjustable sleeve member on the shaft, said sleeve member being provided with two engagement members, each adapted to receive and hold one of said rods by engaging one of said slots, so that said calf and thigh support members can be held in desired positions; and a second locking means for fixing the sleeve in a desired position relative to the shaft.

2. A stirrup attachment according to claim 1 wherein said attachment member comprises a pin portion adapted for insertion into a suitable receptacle mounted on a surgical table.

3. A stirrup attachment according to claim 1 wherein said first locking means is frictionally engageable.

4. A stirrup attachment according to claim 1 wherein the two engagement members comprise two U-shaped members attached to opposite sides of the sleeve in a direction parallel to the shaft, the lower portion of the first U-shaped member being adapted to engage a slot of the first rod and the lower portion of the second U-shaped member being adapted to engage a slot of the second rod.

5. A stirrup attachment according to claim 1 wherein said second locking means is frictionally engageable.

6. A stirrup attachment according to claim 1 which is constructed of metal, plastic or a combination thereof.

7. A stirrup attachment according to claim 1 wherein said first and second locking means comprise wing-nut and bolt combinations.

8. A surgical table having attached to a portion of the top of said surgical table at least one stirrup attachment, said stirrup attachment comprising:

an extendable support shaft provided at one end with an attachment member for attaching the support shaft to said portion of the top of said surgical table and hinging means at its other end, the shaft being rotatable about the attachment member;

a first locking means for fixing the support shaft in a desired position relative to the attachment member;

an adjustable calf support member, comprising a portion adapted to receive and support a human calf hingedly attached at one end to said hinging means and a first rod provided with a series of slots pivotally attached to the other end of said calf support portion;

an adjustable thigh support member, comprising a portion adapted to receive and support a human thigh, hingedly attached at one end to said hinging means opposite said calf support portion and a second rod provided with a series of slots pivotally attached to the other end of said thigh support portion;

a slideably adjustable sleeve member on the shaft, said sleeve member being provided with two engagement members, each adapted to receive and hold one of said rods by engaging one of said slots, so that said calf and thigh support members can be held in desired positions; and a second locking means for fixing the sleeve in a desired position relative to the shaft.

9. A surgical table in accordance with claim 8, wherein said portion of the top of said surgical table to which said stirrup attachment is attached is hingedly moveable relative to the rest of the top of said surgical table.

* * * * *